United States Patent [19]

Mishra

[11] Patent Number: 4,687,319

[45] Date of Patent: Aug. 18, 1987

[54] LIQUID CARRIER RECLAIMING APPARATUS

[75] Inventor: Satchidanand Mishra, Webster, N.Y.

[73] Assignee: Xerox Corporation, Stamford, Conn.

[21] Appl. No.: 875,832

[22] Filed: Jun. 18, 1986

[51] Int. Cl.[4] ..... G03G 15/10

[52] U.S. Cl. ..... 355/10; 355/15; 118/61

[58] Field of Search ..... 355/10, 15, 3 R, 14 R; 430/97, 119; 118/61

[56] References Cited

U.S. PATENT DOCUMENTS

| | | | |
|---|---|---|---|
| 2,944,404 | 7/1960 | Fritts | 62/3 |
| 3,767,300 | 10/1973 | Brown et al. | 355/15 |
| 3,880,515 | 4/1975 | Tanaka et al. | 355/10 |
| 3,997,977 | 12/1976 | Katayama et al. | 34/73 |
| 4,462,675 | 7/1984 | Moraw et al. | 355/3 |
| 4,538,899 | 9/1985 | Landa et al. | 355/10 |

FOREIGN PATENT DOCUMENTS

| | | |
|---|---|---|
| 1020992 | 2/1966 | United Kingdom . |
| 1439864 | 6/1976 | United Kingdom . |

*Primary Examiner*—A. C. Prescott

*Attorney, Agent, or Firm*—H. Fleischer; J. E. Beck; R. Zibelli

[57] ABSTRACT

An apparatus in which a developing liquid used in an electrophotographic printing machine to develop an electrostatic latent image on a photoconductive surface is reclaimed. The developing liquid is vaporized to dry the wet copy sheet. The developing liquid vapor enters the chamber of a housing where it is thermoelectrically cooled. In this way, the developing liquid vapor in the chamber of the housing liquefies. A Peltier heat pump is employed to cool the chamber of the housing so as to liquefy the developing liquid vapor.

20 Claims, 3 Drawing Figures

LIQUID CARRIER RECLAIMING APPARATUS

This invention relates generally to an electrophotographic printing machine, and more particularly concerns an apparatus for reclaiming a developing liquid.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer material into contact therewith. In a wet type of development system, a developing liquid composed of a liquid carrier with toner particles dispersed therein wets the photoconductive surface to form a visible image thereon. The visible image on the photoconductive member is transferred to the copy sheet. The copy sheet is now wet having both liquid carrier and toner particles thereon. At this time, the copy sheet passes through a fixing/drying device where the residual liquid carrier is vaporized and the toner particles permanently fused to the copy sheet, in image configuration. Hereinbefore, the vaporized liquid carrier was expelled to the atmosphere. This resulted in pollution of the atmosphere. In relatively low volume copying machines having only periodic use, this type of pollution was not very significant. However, with the advent of high volume copying machine, the problem of pollution from vaporized liquid carrier is aggravated. Some of the suggested techniques for solving this problem, such as venting the vaporized liquid carrier to the open atmosphere or burning it in a closed chamber, are either impractical or not very cost effective. For example, the cost of plumping in a corporate office to vent the vaporized liquid carrier into the open atmosphere would be exorbitant. The significance of this pollution may be readily understood by the fact that a copying machine capable of making 10,000 copies per day will yield about 1.6 kilograms of vaporized liquid carrier. This pollution makes any area wherein the copying machine is located intolerable to human operators. In order to provide a solution to this problem, it has been recommended that the vaporized liquid carrier be condensed and recovered for subsequent reuse within the printing machine. Various techniques have been devised for achieving the foregoing. The following disclosures appear to be relevant:

- U.S. Pat. No. 2,944,404, Patentee: Fritts, Issued; July 12, 1960.
- U.S. Pat. No. 3,767,300, Patentee: Brown et al., Issued: Oct. 23, 1973.
- U.S. Pat. No. 3,880,515, Patentee: Tanaka et al., Issued: Apr. 29, 1975.
- U.S. Pat. No. 3,997,977, Patentee: Katuyma et al., Issued: Dec. 21, 1976.
- U.S. Pat. No. 4,462,675, Patentee: Moraw et al., Issued: July 31, 1984.
- U.K. Pat. No. 1,020,992, Patentee: Hodding, Published: Feb. 23, 1966.
- U.K. Pat. No. 1,439,864, Patentee: Canon, Published: June 16, 1976.

The relevant portions of the foregoing disclosures may be briefly summarized as follows:

Fritts describes a dehumidifier which has a heat pump condensing apparatus based on the Peltier effect.

Brown et al. discloses a process which cleans the exhaust fumes prior to their exit from a duplicating machine. The carrier liquid and water vapors are condensed, separated and the carrier fluid is recirculated. This cooling system uses a liquid refrigerant to form a cold trap.

Tanaka et al. discloses cooling a carrier vapor to a mist, indirectly by using cooling fans. The mist is liquefied by corona charge from screen like metal nets, electrically conductive wires or electrically conductive plates.

Katayama et al. describes a developing liquid recovery device using an orthogonal flow type heat exchanger as a condenser to form a liquid vapor mist and a mist collector of the corona discharge type.

Moraw et al. discloses a developing liquid recovery process in which vapor is cooled through a coil using ambient air. Also disclosed is a process of converting the vaporized developing liquid into a fog, and separating the fog by electrostatic filters using corona charging.

Hodding describes a liquid vapor recovery process in a copying machine. A cooling/collecting chamber is employed which is similar to a conventional refrigerator or dehumidifier.

The Canon patent described a Peltier condensor for treating tobacco fumes prior to exposing an individual thereto.

In accordance with one aspect of the present invention, there is provided an apparatus for reclaiming a developing liquid. The apparatus includes a housing defining a chamber having inlet and outlet ports. A developing liquid vapor enters the chamber through the inlet port and developing liquid exits the chamber through the outlet port thereof. Means are provided for thermoelectrically cooling the developing liquid vapor in the chamber of the housing to liquefy the developing liquid vapor therein.

Pursuant to another aspect of the present invention, there is provided an electrophotographic printing machine of the type in which an electrostatic latent image is recorded on a photoconductive surface. Means develop the electrostatic latent image with developing liquid in image configuration. Means transfer the liquid image from the photoconductive surface to a copy sheet. Means are provided for vaporizing the developing liquid to dry the copy sheet wet with developing liquid. A housing, defining a chamber having an inlet port in communication with the vaporizing means and an outlet port, is provided so that the developed liquid vapor enters the chamber through the inlet port and developing liquid exits the chamber through the outlet port thereof. Means thermoelectrically cool the developing liquid vapor in the chamber of the housing to liquefy the developing liquid vapor therein.

Still another aspect of the present invention is an apparatus for controlling environmental pollution produced by vaporized liquid carrier escaping from a unit of a reproducing machine drying a copy sheet wet with liquid developer material having liquid carrier with tone particles. Means, in communication wth the drying unit of the reproducing machine, remove the vaporized liquid carrier. A housing having a chamber in communication with the removing means receives the vaporized liquid carrier. A Peltier heat pump having a heat absorbing portion operatively associated with the housing cools the housing to condense the vaporized liquid carrier in the chamber thereof. The Peltier heat pump has a heat emitting portion to dissipate heat therefrom.

Other features of the present invention will become apparent as the following description proceeds and upon reference to the drawings in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
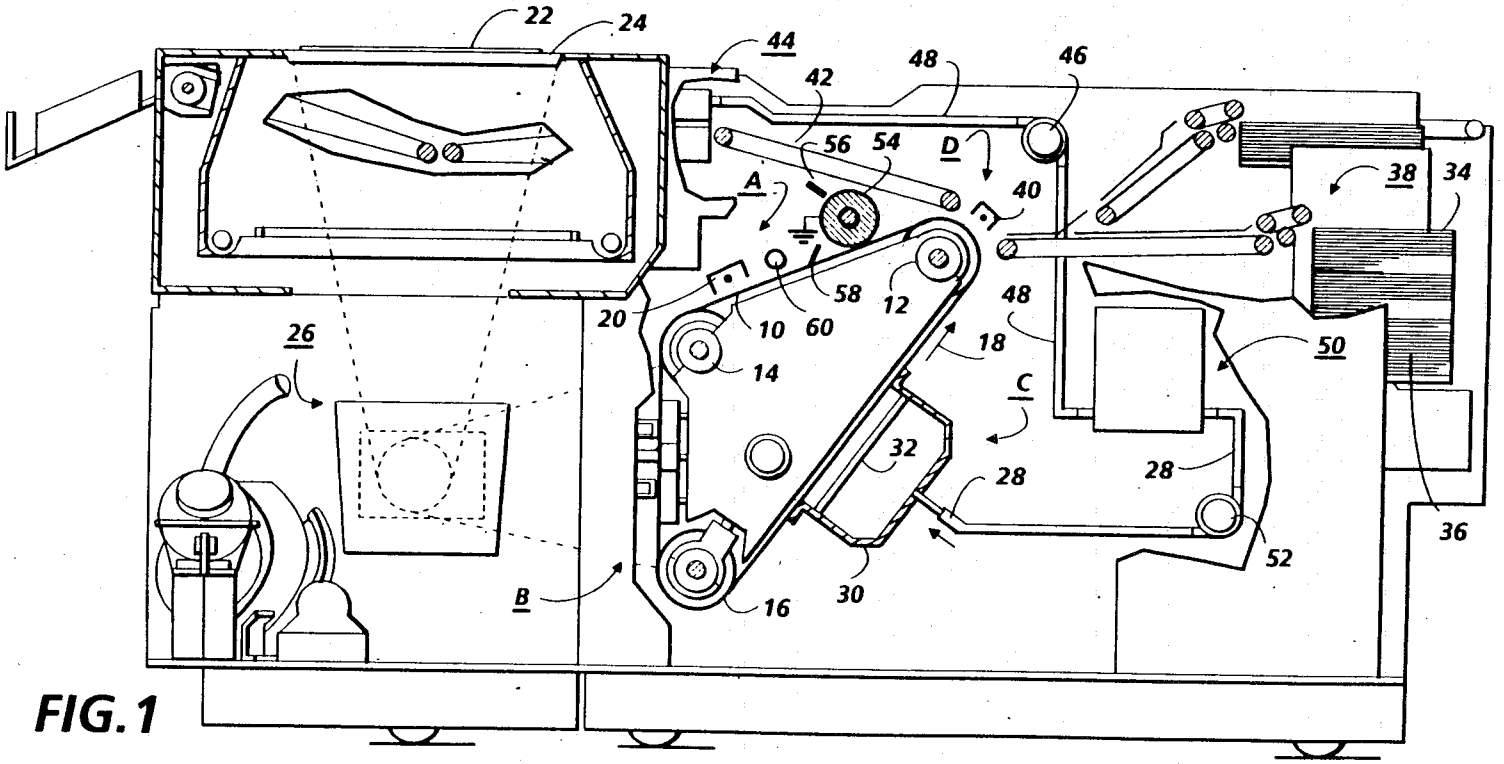
FIG. 1 is a schematic, elevational view of an electrophotographic printing machine incorporating the features of the present invention therein.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion, that the apparatus of the present invention is equally well suited for use in a wide variety of printing machines and is not necessarily limited in its application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers, 12, 14 and 16 located with parallel axes at approximately the apexes of a triangle. Roll 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed face down upon a transparent support platen 24. An illumination assembly, indicated generally by the reference numeral 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface corresponding to the informational areas contained within original document 22.

After the electrostatic latent image has been recorded on the photoconductive surface of belt 10, belt 10 advances the electrostatic latent image to development station C. At development station C, a developing liquid, comprising at least an insulating carrier liquid and toner particles, i.e., pigmented marking particles, is circulated through pipe 28 into development tray 30. Development electrodes 32, which may be appropriately electrically biased, assist in depositing toner particles on the electrostatic latent image as it passes in contact with the developing fluid. The charged toner particles, disseminated through the carrier liquid, pass by electrophoresis to the electrostatic latent image. The charge of the toner particles is opposite in polarity to the charge on the photocoductive surface. For example, if the photoconductive surface is made from a selenium alloy, the corona charge will be positive and the toner particles will be negatively charged. Alternatively, if the photoconductive surface is made from a cadmium sulfide material, the charge will be negative and the toner particles will have a positive charge. Normally, the amount of liquid on the photoconductive surface is excessive. Accordingly, a roller (not shown) whose surface moves in a direction opposite to the direction of movement of belt 10 is spaced from the photoconductive surface and adapted to shear excessive liquid from the developed image without disturbing the image. A suitable developer material is described in U.S. Pat. No. 4,582,774 issued to Landa in 1986, the relevant portions thereof being hereby incorporated into the present application. By way of example, the insulating carrier liquid may comprise at least a hydrocarbon liquid, although other insulating liquids may also be employed. A suitable hydrocarbon liquid is an Isopar, which is a trademark of the Exxon Corporation. These are branched aliphatic hydrocarbon liquids (largely decane). The toner particles comprise at least a binder and pigment. The pigment may be carbon black. However, one skilled in the art will appreciate that any suitable liquid developer material may be employed. The liquid developer material is reclaimed and recirculated to development tray 30. The arrangement for reclamation of the liquid developer material will be described hereinafter with reference to the fusing and drying stations employed in the printing machine.

With continued reference to FIG. 1, after the electrostatic latent image is developed, belt 10 advances the developed image to transfer station D. At transfer station D, a sheet of support material 34 is advanced from stack 36 by a sheet transport mechanism indicated generally by the reference numeral 38. Transfer station D includes a corona generating device 40 which sprays ions onto the backside of the sheet of support material 34. This attracts the developed image from the photoconductive surface of belt 10 to copy sheet 34. Ideally, only the toner particles will be transferred to the copy sheet. However, in actuality, a portion of the carrier liquid as well as the toner particles are transferred to the copy sheet. Thus, the copy sheet is in a wet condition as it advances from transfer station D to fusing station E. Conveyor belt 42 is adapted to move the sheet of support material, i.e. the copy sheet to fusing station E.

Fusing and drying station E includes a fuser assembly, indicated generally by the reference numeral 44, which permanently fuses the developed image to the copy sheet. In addition, the fusing assembly vaporizes the liquid carrier adhering to the copy sheet. Fusing assembly 44 includes a heated fuser roller and back-up or pressure roll resiliently urged into engagement therewith to form a nip through which the copy sheet passes. A vacuum pump 46, associated with the housing of fusing and drying station 44, draws the vaporized liquid carrier through pipe 48 into a reclaiming apparatus, indicated generally by the reference numeral 50. Reclaiming apparatus 50 condenses the vaporized liquid carrier. The liquid carrier is then pumped by pump 52 through pipe 28 back into tray 30 of development station C for subsequent reuse. The detailed structure of reclaiming apparatus 50 will be described hereinafter with reference to FIGS. 2 and 3.

After the developed image is transferred to the copy sheet, residual liquid developer material remains adhering to the photoconductive surface of belt 10. A cleaning roller 54 formed of any appropriate synthetic resin, is driven in a direction opposite to the direction of movement of belt 10 to scrub the photoconductive surface clean. To assist in this cleaning action, developing liquid may be fed through pipe 56 to the surface of cleaning roller 54. A wiper blade 58 completes the cleaning of the photoconductive surface. Any residual charge left on the photoconductive surface is extinguished by flooding the photoconductive surface with light from lamp 60.

Figure 2:
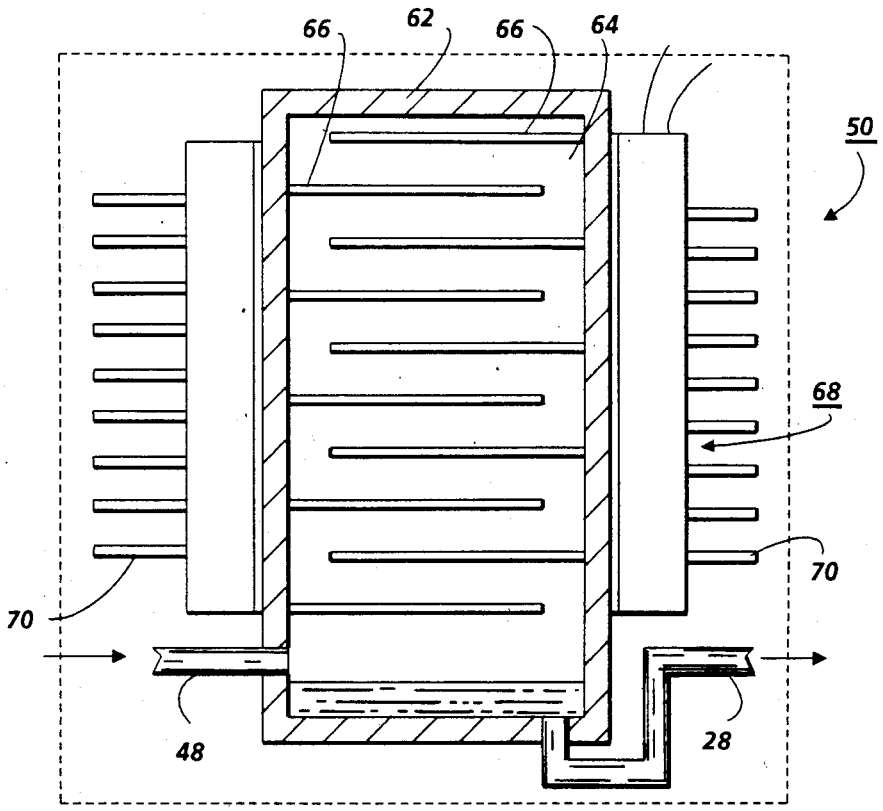
FIG. 2 is a schematic elevational view of the thermoelectric cooling device employed in the FIG. 1 printing machine.

Referring now to FIG. 2, there is shown the detailed structure of reclaiming apparatus 50. Reclaiming apparatus 50 includes a housing 62 defining a chamber 64. A plurality of spaced apart fins 66 extend inwardly into chamber 64 from opposite walls of housing 62. Pipe 48 is connected to housing 62 permitting vaporized liquid carrier to enter into chamber 64. A thermoelectric cooler, indicated generally by the reference numeral 68, is wrapped about the exterior surface of housing 62. Preferably, thermoelectric cooler 68 is a Peltier cooler. The detailed structure of thermoelectric cooler 68 will be described hereinafter with reference to FIG. 3. Spaced apart fins 70 extend outwardly from thermoelectric cooler 68. In operation, thermoelectric cooler 68 cools the exterior walls of housing 62 which, in turn, cool fins 66. The vaporized liquid carrier in chamber 64 condenses on the cooled surface of fins 66 and liquefies thereon. Fins 70 cool thermoelectric cooler 68 by dissipating the heat produced during the cooling of housing 62 into the atmosphere. The liquid, condensed carrier vapor is discharged from housing 62 through pipe 50 back to development tray for subsequent reuse in the development system. Preferably, housing 62 is a rectangular metallic chamber filled with metallic foils or fins 66. The outside walls of housing 62 have thermoelectric cooler 68 mounted thereon. Fins 70 radiate the heat to the atmosphere. In addition, a cooling fan can be positioned closely adjacent to fins 70 to provide forced air cooling thereof. It is estimated that an electrophotographic printing machine capable of making 10,000 copies per day will yield about 1.6 kilograms of liquid carrier. In order to condense the vaporized liquid carrier, the total heat transferred is estimated to be 16 joules per second. Thermoelectric cooler 68 is capable of pumping approximately 20 watts and is preferably made from lead tellurium or tetradymite semi-conducting materials. The detailed structure of thermoelectric cooler 68 is shown in FIG. 3.

Figure 3:
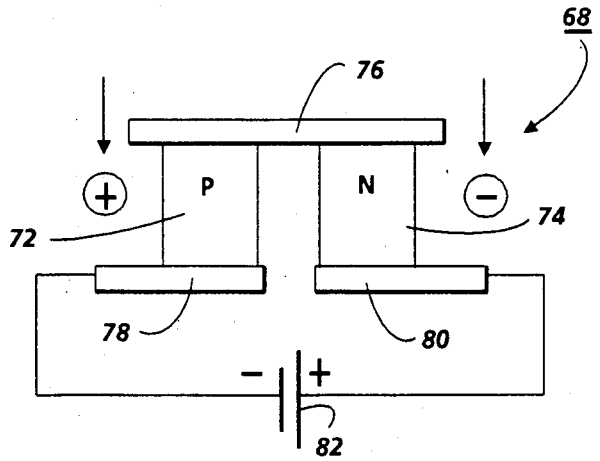
FIG. 3 is a schematic, circuit diagram of the thermoelectric cooler employed in the FIG. 2 cooling device.

As shown in FIG. 3, thermoelectric cooler 68 includes a bank of positive thermoelements 72 spaced from a bank of negative thermoelements 74. A cold thermojunction 76 is connected to one side of the bank of positive thermoelements and to one of the bank of negative thermoelements 74. The other side of the bank of positive thermoelements is connected to hot thermojunction 78. The other side of the bank of negative thermoelemetns 74 is connected to hot thermojunction 80. Hot thermojunction 78 and hot thermojunction 80 are insulated from one another, i.e. spaced from one another. The negative side of voltage source 82 is connected to hot thermojunction 78 with the positive side of voltage source 82 being connected to hot thermojunction 80. Cold thermojunction 76 is positioned in contact with the exterior walls of housing 62. Cooling fins 70 extend outwardly from hot thermojunctions 78 and 80 to provide cooling for cooling apparatus 68. Thus, it is seen that the bank of thermoelectric elements 72 include a plurality of positive elements with the bank of thermoelements 74 comprising a plurality of negative elements. One type of Peltier cooling apparatus is described in U.S. Pat. No. 2,944,404 issued to Fritts, in 1960, the relevant portions thereof being hereby incorporated into the present application.

In recapitulation, it is clear that the thermoelectric cooling apparatus of the present invention requires only electrical power and does not need any plumbing or special installation. This apparatus cools a housing which, in turn, collects the liquefied vaporized liquid carrier and provides an egress therefrom for returning the liquid carrier to the development system. The apparatus for cooling the housing in which the vaporized liquid carrier condenses is a thermoelectric cooler, i.e., a Peltier cooler, which employs positive and negative thermoelectric cooling elements and hot and cooled thermojunctions to effect cooling of the housing and the resultant condensation of the vaporized liquid carrier therein for subsequent reclamation in the printing machine. This apparatus is economical and does not require any motor such as is employed in a compressor. Thus, there are no moving parts and the device is essentially noise free and of extended life and durability.

It is, therefore, apparent that there has been provided, in accordance with the present invention, an apparatus for reclaiming a liquid developer material used in an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and scope of the appended claims.

I claim:

1. An apparatus for reclaiming a developing liquid, including:

a housing defining a chamber having inlet and outlet ports with a developing liquid vapor entering the chamber through the inlet port and developing liquid exiting the chamber through the outlet port thereof; and means for thermoelectrically cooling the developing liquid vapor in the chamber of said housing to liquefy the developing liquid vapor therein.

2. An apparatus according to claim 1, wherein said cooling means includes:

first and second thermoelements;

a first hot thermojunction mounted on one edge of said first thermoelement;

a second hot thermojunction, spaced from said first thermojunction, mounted on one edge of said second thermoelement;

a cold thermojunction mounted on the other edge of said first thermoelement and the other edge of said second thermoelement; and a voltage source electrically connected to said first hot thermojunction and said second hot thermojunction.

3. An apparatus according to claim 2, wherein said cold thermojunction is mounted on the exterior surface of said housing to absorb heat therefrom providing a cold surface in the chamber of said housing to liquefy the developing liquid vapor thereon.

4. An apparatus according to claim 3, wherein said cooling means includes a plurality of spaced apart cooling fins extending outwardly from said hot thermojunctions to dissipate heat therefrom.

5. An apparatus according to claim 4, wherein said housing includes a plurality of condensing fins extending into the chamber of said housing from the interior surface thereof, said condensing fins being cooled by said cold thermojunction to provide a cold surface for liquefying the developing liquid vapor.

6. An electrophotographic printing machine of the type in which an electrostatic latent image is recorded on a photoconductive surface, wherein the improvement includes:

means for developing the electrostatic latent image with a developing liquid in image configuration;

means for transferring the liquid image from the photoconductive surface to a copy sheet;

means for vaporizing the developing liquid to dry the copy sheet wet with developing liquid;

a housing defining a chamber having an inlet port in communication with said vaporizing means and an outlet port so that developing liquid vapor enters the chamber through the inlet port and developing liquid exits the chamber through the outlet port thereof; and means for thermoelectrically cooling the developing liquid vapor in the chamber of said housing to liquefy the developing liquid vapor therein.

7. A printing machine according to claim 6, wherein said cooling means includes:

first and second thermoelements;

a first hot thermojunction mounted on one edge of said first thermoelement;

a second hot thermojunction, spaced from said first thermojunction, mounted on one edge of said second thermoelement;

a cold thermojunction mounted on the other edge of said first thermoelement and the other edge of said second theremoelement; and a voltage source electrically connected to said first hot thermojunction and said second hot thermojunction.

8. A printing machine according to claim 7, wherein said cold thermojunction is mounted on the exterior surface of said housing to absorb heat therefrom providing a cold surface in the chamber of said housing to liquefy the developing liquid vapor thereon.

9. A printing machine according to claim 8, wherein said cooling means includes a plurality of spaced apart cooling fins extending outwardly from said hot thermojunctions to dissipate heat therefrom.

10. A printing machine according to claim 9, wherein said housing includes a plurality of condensing fins extending into the chamber of said housing from the interior surface thereof, said condensing fins being cooled by said cold thermojunction to provide a cold surface for liquefying the developing liquid vapor.

11. A printing machine according to claim 6, wherein the outlet port of said housing is in communication with said developing means to recycle the developing liquid from the chamber of said housing to said developing means for reuse.

12. An apparatus for controlling environmental pollution produced by vaporized liquid carrier escaping from a unit of a reproducing machine drying a copy sheet wet with liquid developer material having liquid carrier with toner particles, including:

means, in communication with the drying unit of the reproducing machine, for removing the vaporized liquid carrier;

a housing having a chamber in communication with said removing means for receiving the vaporized liquid carrier; and a Peltier heat pump having a heat absorbing portion operatively associated with said housing to cool said housing and condense the vaporized liquid carrier in the chamber thereof and a heat emitting portion to dissipate heat therefrom.

13. An apparatus according to claim 12, wherein the reproducing machine includes a reservoir for storing a supply of liquid developer.

14. An apparatus according to claim 13, further including means for returning condensed liquid carrier from the chamber of said housing to said reservoir.

15. An apparatus according to claim 14, wherein said Peltier heat pump includes:

first and second thermoelements;

a first hot thermojunction mounted on one edge of said first thermoelement;

a second hot thermojunction, spaced from said first thermojunction, mounted on one edge of said second thermoelement;

a cold thermojunction mounted on the other edge of said first thermoelement and the other edge of said second thermoelement; and a voltage source electrically connected to said first hot thermojunction and said second hot thermojunction.

16. An apparatus according to claim 15, wherein the heat absorbing portion of said Peltier heat pump includes said cold thermojunction mounted on the exterior surface of said housing to absorb heat therefrom providing a cold surface in the chamber of said housing to condense the vaporized liquid carrier in the chamber thereof.

17. An apparatus according to claim 16, wherein the heat emitting portion of said Peltier heat pump includes said first hot thermojunction and said second hot thermojunction.

18. An apparatus according to claim 17, wherein the heat emitting portion of said Peltier heat pump includes a plurality of spaced apart cooling fins extending outwardly from said hot thermojunctions to dissipate heat therefrom.

19. An apparatus according to claim 18, wherein said housing includes a plurality of condensing fins extending into the chamber of said housing from the interior surface thereof, said ocndensing fins being cooled by said cold thermojunction to provide a cold surface for liquefying the vaporized liquid carrier in the chamber of said housing.

20. An apparatus according to claim 19, wherein the reproducing machine includes a liquid development system operatively associated with said reservoir to receive liquid carrier therefrom.

* * * * *